US006874487B2

(12) United States Patent
Murphy

(10) Patent No.: US 6,874,487 B2
(45) Date of Patent: Apr. 5, 2005

(54) DUAL SEAL EGR TUBE ASSEMBLY

(75) Inventor: Kevin A. Murphy, Sterling Heights, MI (US)

(73) Assignee: Siemens VDO Automotive, Inc., Chatham (CA)

( * ) Notice: Subject to any disclaimer, the term of this patent is extended or adjusted under 35 U.S.C. 154(b) by 0 days.

(21) Appl. No.: 10/644,451

(22) Filed: Aug. 20, 2003

(65) Prior Publication Data

US 2004/0040549 A1 Mar. 4, 2004

Related U.S. Application Data

(60) Provisional application No. 60/406,821, filed on Aug. 29, 2002.

(51) Int. Cl.[7] ..... F02M 25/07
(52) U.S. Cl. ..... 123/568.17
(58) Field of Search ..... 123/568.11, 568.17, 123/568.18, 568.19

(56) References Cited

U.S. PATENT DOCUMENTS

| | | | | |
|---|---|---|---|---|
| 5,094,218 A | | 3/1992 | Everingham | |
| 5,492,104 A | | 2/1996 | Elder | |
| 5,511,531 A | | 4/1996 | Cook | |
| 5,531,205 A | | 7/1996 | Cook | |
| 5,542,711 A | * | 8/1996 | Vaudry | 123/568.17 |
| 5,722,634 A | | 3/1998 | Hrytzak | |
| 6,116,224 A | | 9/2000 | Cook | |
| 6,173,701 B1 | * | 1/2001 | Azuma | 123/568.17 |
| 6,209,529 B1 | | 4/2001 | Everingham | |
| 6,244,255 B1 | | 6/2001 | Sagata | |
| 6,247,461 B1 | | 6/2001 | Smith | |
| 6,293,265 B1 | * | 9/2001 | Gagnon | 123/568.17 |
| 6,415,777 B1 | | 7/2002 | Gagnon | |
| 6,422,221 B2 | * | 7/2002 | Pietrowski et al. | 123/568.17 |
| 6,470,866 B2 | | 10/2002 | Cook | |
| 6,474,320 B1 | | 11/2002 | Modien | |
| 6,513,508 B2 | * | 2/2003 | Fischer et al. | 123/568.17 |
| 6,698,407 B2 | * | 3/2004 | Ikegawa | 123/568.17 |

OTHER PUBLICATIONS

US 6,095,122, 8/2000, Everingham (withdrawn)

* cited by examiner

*Primary Examiner*—Willis R. Wolfe, Jr.

(57) ABSTRACT

An exhaust gas re-circulation (EGR) tube includes a dual seal assembly that prevents exhaust gas leakages. The EGR tube has a first end in communication with an exhaust gas source and has a second end extending into an intake manifold enclosed within an intake manifold housing. A tapered sleeve surrounds the EGR tube at the second end. The sleeve has a first end that is directly attached to the EGR tube and a second end that is spaced apart from the EGR tube to define a gap. The sleeve has a tapered body such that the cross-sectional area of the gap increases from the first end to the second end of the sleeve. A first seal is positioned between the sleeve and the intake manifold housing and a second seal is positioned between the sleeve and the intake manifold. Grooves are formed within the exterior surface of the tube to receive the seals.

20 Claims, 4 Drawing Sheets

DUAL SEAL EGR TUBE ASSEMBLY

CROSS-REFERENCE TO RELATED APPLICATIONS

The application claims priority to U.S. Provisional Application No. 60/406,821, which was filed on Aug. 29, 2002.

BACKGROUND OF THE INVENTION

This invention relates to an exhaust gas re-circulation (EGR) tube that includes a dual seal assembly.

EGR tubes are used to re-circulate exhaust gases from the engine cylinders back into an intake manifold. The intake manifold is traditionally directly mounted, as an exposed component, to the engine for directing airflow into the engine. To facilitate assembly of the intake manifold and other associated components to the engine, it is desirable to have a more modular design that can be quickly and efficiently mounted to the engine. The modular design provides a housing that encloses the intake manifold and associated components. The housing and intake manifold components are pre-assembled and then are mounted to the engine as a unit.

An EGR tube has a first end in communication with an exhaust gas source and a second end in communication with the intake manifold. As the exhaust gases are transferred through the tube to the intake manifold, leakages can occur. Clean air from the external atmosphere can leak into the tube and/or the exhaust gases can leak out of the tube prior to being transferred back into the intake manifold. Either type of leak decreases the overall engine performance.

Traditionally, a single seal has been used to seal the tube to the intake manifold. This seal has not been effective in eliminating both types of EGR tube leaks in a configuration where the intake manifold is enclosed within a housing. Thus, it is desirable to have an improved sealing system to prevent clean air from leaking into the tube and to prevent exhaust gases from leaking out of the tube prior to entry into the intake manifold.

SUMMARY OF THE INVENTION

An exhaust gas re-circulation (EGR) system includes a tube that has a first end in communication with an exhaust gas source and a second end in communication with an engine intake manifold. First and second seals, longitudinally spaced apart from one another, seal the tube to the intake manifold.

In one disclosed embodiment, the intake manifold is enclosed within an intake manifold housing. One of the seals is positioned between the tube and the intake manifold housing and the other seal is positioned between the intake manifold and the tube. Preferably, the tube is received within a sleeve that surrounds the second end of tube. The sleeve is attached to the tube at a first end and is spaced apart from the tube at a second end to define a gap. The gap allows cooling air flow to surround the tube prior to entry into the intake manifold.

In one disclosed embodiment, the sleeve has a tapered body that decreases in diameter from the intake manifold housing end toward the intake manifold end. Grooves are formed on an exterior surface of the tube to receive the seals.

The subject invention provides an improved seal assembly that eliminates system leaks. These and other features of the present invention can be best understood from the following specifications and drawings, the following of which is a brief description.

DETAILED DESCRIPTION OF A PREFERRED EMBODIMENT

Figure 1:
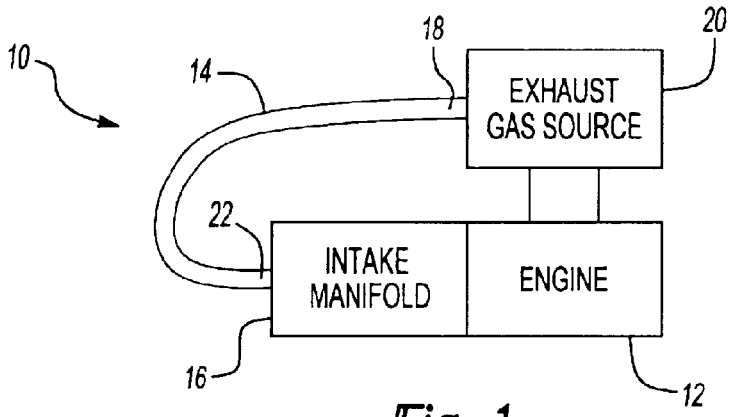
FIG. 1 is a schematic diagram of an EGR system incorporating the subject invention.

As shown in FIG. 1, an exhaust gas re-circulation (EGR) system 10 for a vehicle engine 12 includes an EGR tube 14 that is used to re-circulate exhaust gases from the engine 12 back into an intake manifold 16. The EGR tube 14 has a first end 18 in communication with an exhaust gas source 20 and a second end 22 in communication with the intake manifold 16.

Figure 2:
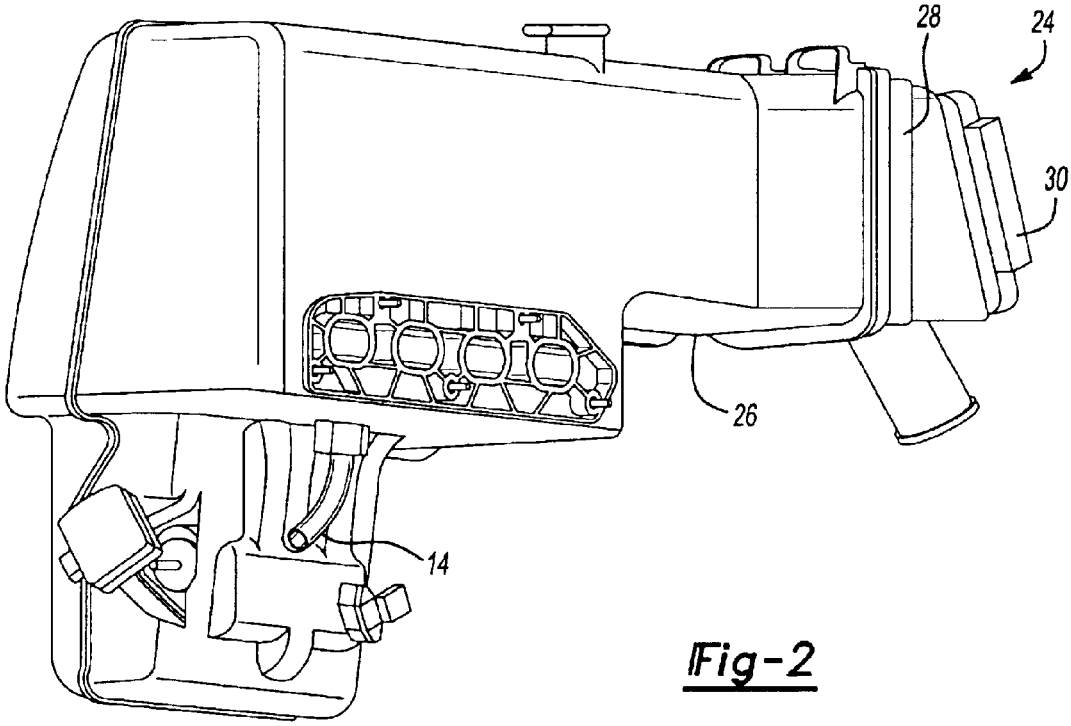
FIG. 2 is a perspective view of an intake module assembly incorporating the subject invention.

The intake manifold 16 is part of a main air intake module assembly 24, shown in FIG. 2. The main intake module assembly 24 includes an air intake housing 26, air cleaner assembly 28, and an electronic control unit (ECU) 30. The EGR tube 14 extends into the air intake housing 26 for connection to the intake manifold 16.

Figure 3:
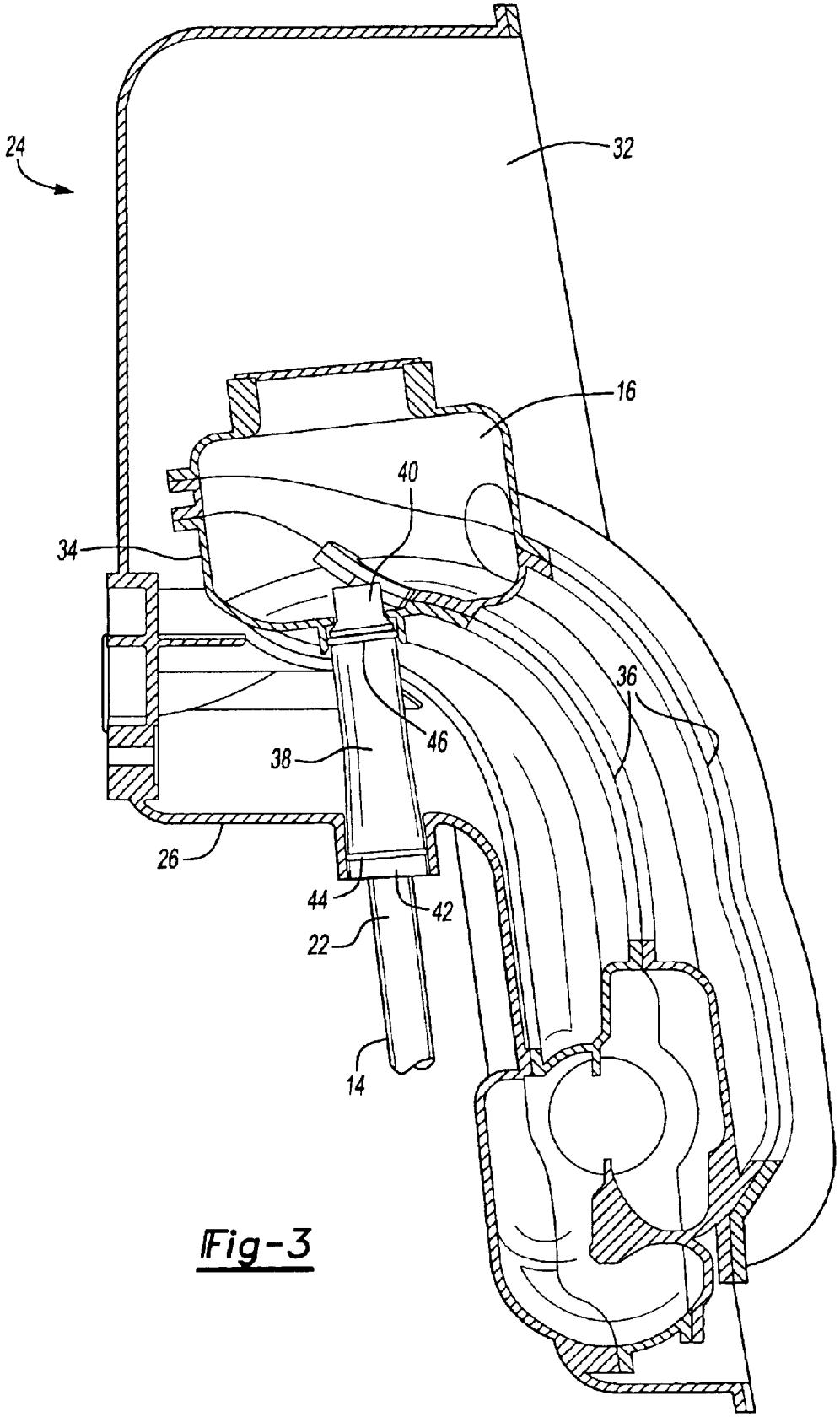
FIG. 3 is a partial cross-sectional view, partially broken away, of the intake module assembly of FIG. 2.

As shown in FIG. 3, the air intake housing 26 defines a cavity 32 within which the intake manifold 16 is positioned. The intake manifold 16 includes a main air intake portion 34 and a plurality of runners 36 each of which communicate with one of the engine cylinders. The main air intake portion 34 and runners 36 are substantially enclosed within the air intake housing 26. The EGR tube 14 extends through the air intake housing 26 and into the main air intake portion 34 of the intake manifold 16.

A sleeve 38 surrounds the EGR tube 14 at the second end 22, which extends into the main air intake module assembly 24. The sleeve 38 includes a first end 40 that cooperates with the intake manifold 16 and a second end 42 that cooperates with the air intake housing 26. A first seal assembly 44 seals between the sleeve 38 and the air intake housing 26 and a second seal assembly 46 seals between the sleeve 38 and the main air intake portion 34 of the intake manifold 16.

Figure 4:
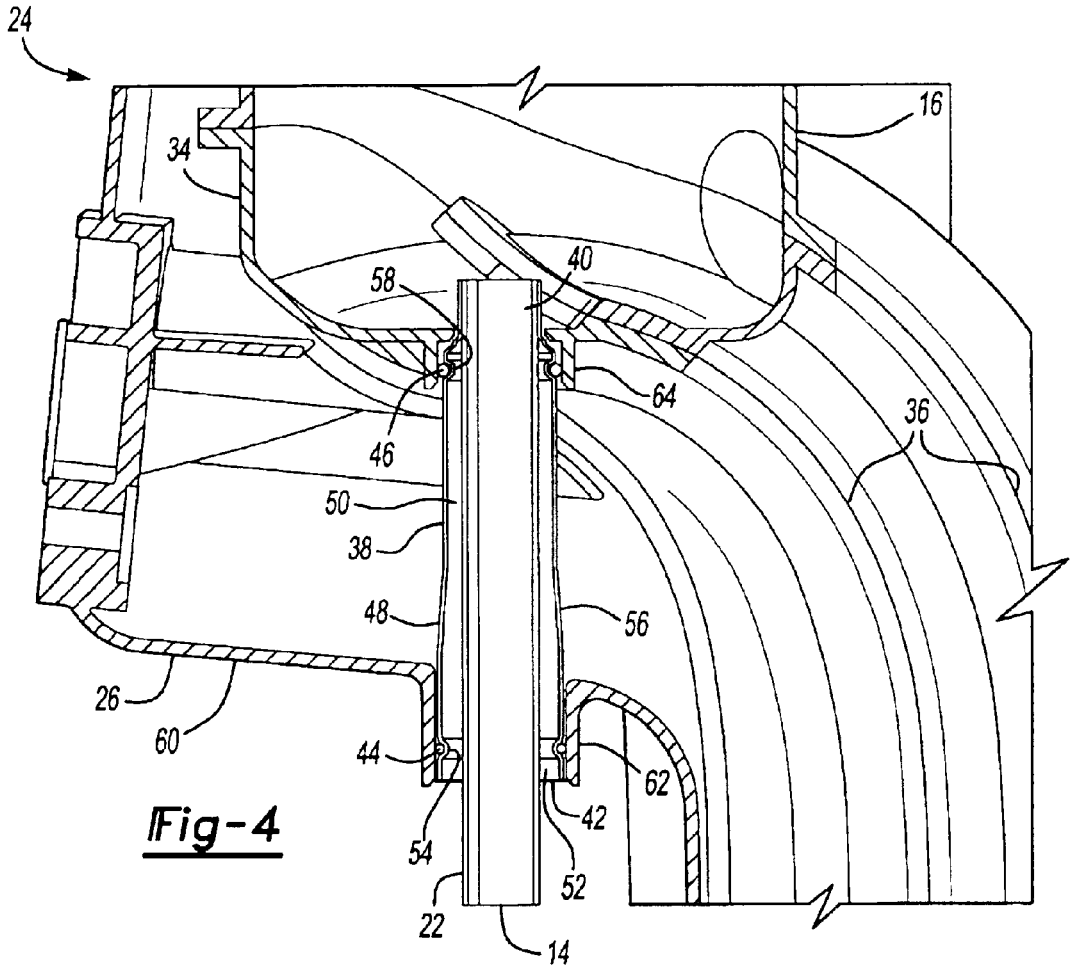
FIG. 4 is a magnified cross-sectional view of the assembly of FIG. 3.

As shown in FIG. 4, the sleeve 38 includes a tapered body portion 48 positioned between the first 40 and second 42 ends. The sleeve 38 includes a longitudinal bore 50 in which the EGR tube 14 is received. The sleeve 38 is directly attached to the EGR tube 14 at the first end 40 of the sleeve 38 such that there is no gap between the sleeve 38 and the tube 14 at the sleeve. The sleeve 38 is preferably formed from tubing that is brazed or welded to the EGR tube 14, however, other similar attachment methods could also be used.

The second end 42 of the sleeve 38 is spaced apart from the EGR tube 14 to form a gap 52 that extends in a direction parallel to the longitudinal bore 50. Thus, the second end 42 of the sleeve 38 is preferably of greater diameter than the first end 40 of the sleeve 38. Further, the tapered body portion 48 allows the cross-sectional area of the gap 52 to vary along the length of the EGR tube 14. The gap 52 decreases in size as the sleeve 38 extends from the second end 42 to the first end 40. The gap 52 provides a cooling medium to prevent the temperature of the sleeve 38 from getting too high due to proximity of the EGR tube 14.

A first groove 54 is formed on an exterior surface 56 of the second end 42 of the sleeve 38 and a second groove 58, longitudinally spaced from the first groove 54, is formed on the exterior surface 56 of the first end 40 of the sleeve 38. The first seal assembly 44 is received in the first groove 54 and the second seal assembly 46 is received within the second groove 58. The first seal assembly 44 is directly between and directly engages both the sleeve 38 and the air intake housing 26 to prevent air from the external atmosphere from entering the main air intake module assembly 24. The second seal assembly 46 is directly between and directly engages both the sleeve 38 and the main air intake portion 34 of the intake manifold 16 to prevent air and exhaust gases from leaking out from the intake manifold 16.

The air intake housing 26 includes a main body portion 60 and a transversely extending boss 62 that provides a locating and mounting surface for the first seal assembly 44 and the second end 42 of the sleeve. The main air intake portion 34 of the intake manifold includes a boss 64 that provides a locating and mounting surface for the second seal assembly 46 and the first end 40 of the sleeve 38.

Figure 5:
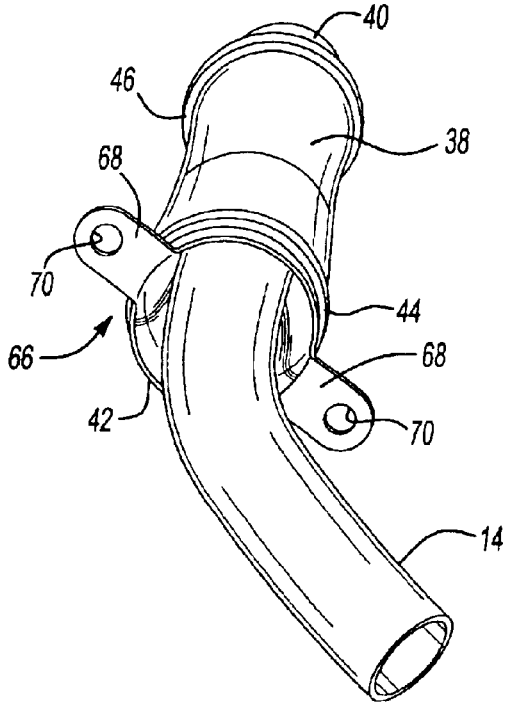
FIG. 5 is a perspective view of an EGR tube and sleeve assembly.
Figure 6:
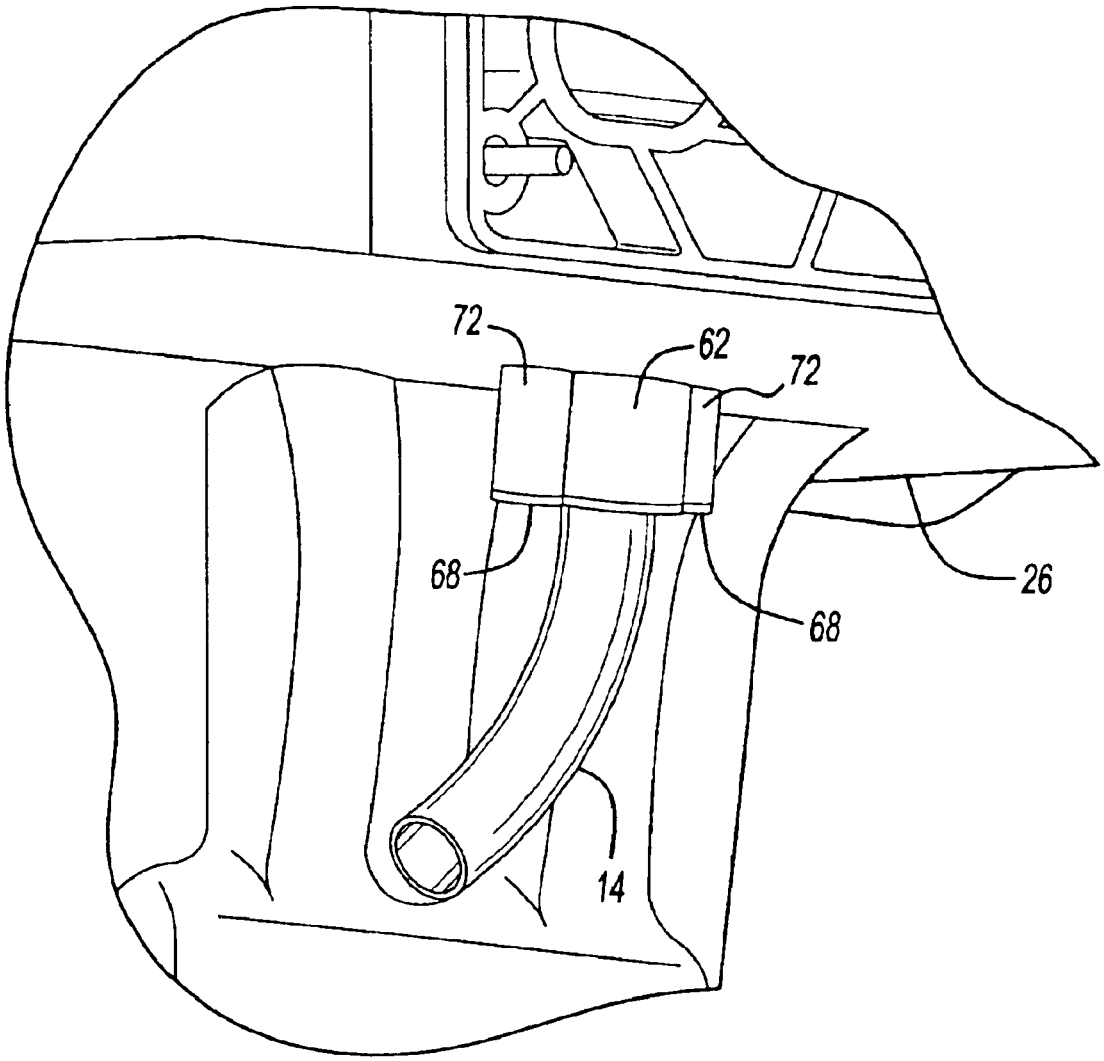
FIG. 6 is a perspective view, partially broken away, showing the EGR tube and sleeve assembly in an installed position in the intake module assembly.

As shown in FIG. 5, the sleeve 38 includes an attachment portion 66 formed at the second end 42 for attachment of the sleeve 38 to the air intake housing 26. The attachment portion 66 preferably includes a pair of tabs 68 with openings 70 to receive fasteners (not shown). The tabs 68 are aligned with boss extensions 72 formed on the boss 62, and the fasteners are inserted through the openings 70 and threaded into the air intake housing 26, as shown in FIG. 6. While fasteners are preferred, any known attachment method could be used to attach the second end 42 of the sleeve 38 to the air intake housing 26.

The subject provides an EGR tube assembly 14 that utilizes a pair of seals 44, 46 to prevent EGR system 10 leakages at the air intake module 24 interface. Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An exhaust gas re-circulation assembly comprising:

an intake housing defining an interior chamber;

an intake manifold positioned within said interior chamber and substantially enclosed by said intake housing;

a tube having a first end in communication with an exhaust gas source and a second end in communication with said intake manifold;

a first seal positioned between said tube and said intake housing; and a second seal positioned between said tube and said intake manifold.

2. The assembly of claim 1 including a sleeve surrounding said second end of said tube, said sleeve being spaced apart from said tube to define a gap extending along a predetermined length of said tube.

3. The assembly of claim 2 wherein said sleeve has a first end directly attached to a portion of said tube and a second end spaced apart from said tube to define said gap.

4. The assembly of claim 2 wherein said gap has a variable cross-sectional area along said predetermined length.

5. The assembly of claim 2 wherein said sleeve includes a tapered body portion.

6. The assembly of claim 2 wherein said first seal is positioned directly between a first end of said sleeve and said intake housing and said second seal is positioned directly between a second end of said sleeve and said intake manifold.

7. The assembly of claim 6 wherein said first end of said sleeve includes a first groove for receiving said first seal and said second end of said sleeve includes a second groove for receiving said second seal.

8. The assembly of claim 7 wherein said intake housing includes a main body portion with a transversely extending boss substantially surrounding said first end of said sleeve.

9. The assembly of claim 7 wherein said intake manifold includes a main body portion with a transversely extending boss substantially surrounding said second end of said sleeve.

10. The assembly of claim 6 wherein said first end of said sleeve has a greater diameter than said second end of said sleeve.

11. The assembly of claim 2 wherein said sleeve includes a mounting portion for attachment to said intake housing.

12. A conduit for transferring exhaust gas to an intake manifold comprising:

a tube having a first end communication with an exhaust gas source and a second end extending into an intake manifold;

a sleeve defining a longitudinal bore wherein said second end of said tube is received within said bore;

a first seal positioned between a first end of said sleeve and a first intake component; and a second seal positioned between a second end of said sleeve and a second intake component.

13. The conduit of claim 12 wherein said first end of said sleeve includes a first groove for receiving Bald first seal and said second end of said sleeve includes a second groove for receiving said second seal.

14. The conduit of claim 12 wherein said first end of said sleeve has a greater diameter than said second end of said sleeve.

15. The conduit of claim 12 wherein said sleeve includes a tapered body portion extending between said first and second ends of said sleeve.

16. The conduit of claim 12 wherein said first intake component comprises an intake manifold housing and said second intake component comprises an intake manifold positioned within said intake manifold housing.

17. The conduit of claim 16 wherein said first seal directly engages said intake manifold housing and said first end of said sleeve and wherein said second seal directly engages said intake manifold and said second end of said sleeve.

18. The conduit of claim 12 wherein said sleeve is circumferentially spaced apart from said tube to define a gap that extends in a direction parallel to said longitudinal bore.

19. The conduit of claim 12 wherein said first and second seals directly engage said sleeve.

20. The conduit of claim 12 wherein said second end of said tube is fixed to said sleeve.

* * * * *